US006458049B2

(12) United States Patent
Bush

(10) Patent No.: US 6,458,049 B2
(45) Date of Patent: Oct. 1, 2002

(54) BASKETBALL SHOOTING PRACTICE RETURN APPARATUS HAVING RETRIEVAL NET FRONT HEIGHT ADJUSTABLE FROM ABOVE

(76) Inventor: James R. Bush, 447 Grazing Rd., Hulett, WY (US) 82720-9642

( * ) Notice: Subject to any disclaimer, the term of this patent is extended or adjusted under 35 U.S.C. 154(b) by 0 days.

(21) Appl. No.: 09/884,554

(22) Filed: Jun. 19, 2001

Related U.S. Application Data

(60) Provisional application No. 60/213,512, filed on Jun. 22, 2000.

(51) Int. Cl.[7] ..... A63B 69/00
(52) U.S. Cl. ..... 473/433
(58) Field of Search ..... 473/431, 432, 473/433, 476–481; D21/702

(56) References Cited

U.S. PATENT DOCUMENTS 5,016,875 A * 5/1991 Joeseph ..... 473/433
5,540,428 A 7/1996 Joseph ..... 273/1.5 A
5,746,668 A * 5/1998 Ochs ..... 473/433
6,056,652 A 5/2000 Lees et al. ..... 473/433
6,267,696 B1 * 7/2001 Mabe et al. ..... 473/433

* cited by examiner

*Primary Examiner*—Paul T. Sewell
*Assistant Examiner*—M. Chambers
(74) *Attorney, Agent, or Firm*—Flanagan & Flanagan; John R. Flanagan

(57) ABSTRACT

A basketball shooting practice return apparatus includes a framework for mounting on a backboard, support members pivotally mounted to the framework below guide elements on the framework and above a hoop on the backboard, a retrieval net assembly supported by the support members and spaced outwardly and hanging downwardly from above the hoop, a net positioning mechanism operable for selectively applying and releasing a pulling force upon the retrieval net assembly and support members from the direction of the guide elements above the backboard so as to be able to pivotally move the net assembly and support members between a raised inclined position extending forwardly and upwardly from the backboard and a lowered vertical position extending downwardly from the backboard and to hold the retrieval net assembly and support members at any stationary position therebetween, and a basketball return structure associated with the retrieval net assembly.

20 Claims, 3 Drawing Sheets

BASKETBALL SHOOTING PRACTICE RETURN APPARATUS HAVING RETRIEVAL NET FRONT HEIGHT ADJUSTABLE FROM ABOVE

This patent application claims the benefit of U.S. provisional application No. 60/213,512, filed Jun. 22, 2000.

BACKGROUND OF THE INVENTION

1. Field of the Invention

The present invention generally relates to a basketball retrieval and return devices and, more particularly, is concerned with a basketball shooting practice return apparatus having a retrieval net supported from above a backboard and a mechanism allowing adjustment of the vertical height of the front portion of the net above the shooting surface so as to establish the arch of the basketball shot that is required to clear the front portion of the net.

2. Description of the Prior Art

One of the problems with solo practice shooting a basketball, such as free throws, is the necessity to retrieve the basketball after each shot. The basketball, whether the shot is made or missed, rarely bounces back to the location of the shooter. After each shot the shooter must chase after the basketball which, more likely than not, is bouncing or rolling away from the shooter. More time is typically consumed going after the errant basketball than actually practicing shots.

A variety of basketball retrieval devices have been proposed in the prior art. Representative of such prior art devices are the ones disclosed in U.S. Pat. No. 6,056,652 to Lees et al. and U.S. Pat. No. 5,540,428 to Joseph. The Lees et al. and Joseph patents disclose basketball retrieval and return devices which appear to be steps in the right direction toward alleviating the aforementioned problem experienced in basketball solo practice shooting by eliminating the need to expend energy in chasing the basketball.

However, another problem of basketball shooting practice is how to train a shooter to learn to shoot the basketball with the needed amount of arch so as to be able to utilize all the available clearance provided between the basketball and hoop and thereby increase the likelihood of the basketball shot scoring by going through the rim or hoop. Neither Lees et al. nor Joseph devices appear to address the problem of training a shooter how to put the necessary arch on the basketball shot.

Consequently, a need still exists for a basketball practice shooting return apparatus which provides solutions to the aforementioned and other problems in the prior art without introducing any new problems in place thereof.

SUMMARY OF THE INVENTION

The present invention provides a basketball shooting practice return apparatus which is designed to satisfy the aforementioned needs. The basketball shooting practice return apparatus of the present invention solves the aforementioned problem providing a means to enable a shooter to practice shooting the basketball with adequate arch on the shot. A retrieval net of the apparatus is supported on and adjusted from above the backboard so as to facilitate easy adjustment of the vertical height of a front portion of the net above the shooting surface. The front portion of the net is used in shooting practice as a visual marker to show the shooter how high the shooter must shoot the basketball or, in other words, what amount of arch the shooter must place on the shot to clear the front portion of the net which will, in turn, be the amount of arch that will maximize the likelihood of the basketball going through the hoop by taking advantage of all the available clearance between the basketball and the backboard hoop which has a larger diameter than the basketball.

Accordingly, the present invention is directed to a basketball shooting practice return apparatus which comprises: (a) a framework for mounting on a backboard and having guide elements disposed above the backboard; (b) a pair of support members pivotally mounted to the framework below the guide elements thereon and above a hoop on the backboard; (c) a retrieval net assembly supported by the support members and spaced outwardly and hanging downwardly from above the hoop; (d) a net positioning mechanism operable for selectively applying and releasing a pulling force upon the retrieval net assembly and support members from the direction of the guide elements above the backboard so as to be able to pivotally move the retrieval net assembly and support members between a raised position extending forwardly from the backboard and a lowered vertical position extending downwardly from the backboard and to hold the retrieval net assembly and support members at any stationary position therebetween; and (e) a basketball return structure associated with the retrieval net assembly.

The present invention also is directed to a basketball shooting practice return apparatus which comprises: (a) a framework mountable on a backboard such that portions of the framework extend beyond opposite lateral sides and above a top side of the backboard and are exposed from forwardly of the backboard, the framework having a pair of guide elements located above the top side of the backboard on the portions of the framework extending above the top side of the backboard; (b) a pair of support members pivotally mounted at inner ends thereof to the portions of the framework extending beyond opposite lateral sides of the backboard such that the inner ends of the support members are located below the guide elements and above a hoop on the backboard; (c) a retrieval net assembly supported by the support members and spaced outwardly and hanging downwardly from above the hoop; (d) a net positioning mechanism operable for selectively applying and releasing a pulling force upon the retrieval net assembly and support members from the direction of the guide elements above the backboard so as to be able to pivotally move the retrieval net assembly and support members from a generally horizontal position extending forwardly from the backboard to a raised inclined position extending forwardly and upwardly from the backboard and above the hoop and to a lowered inclined position extending forwardly and downwardly from the backboard and above the hoop such that the height above the shooting surface of a front portion the retrieval net assembly can be adjusted to act as a visual marker of the proper arch for the shooter to place on the basketball shot; and (e) a basketball return structure associated with the retrieval net assembly.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
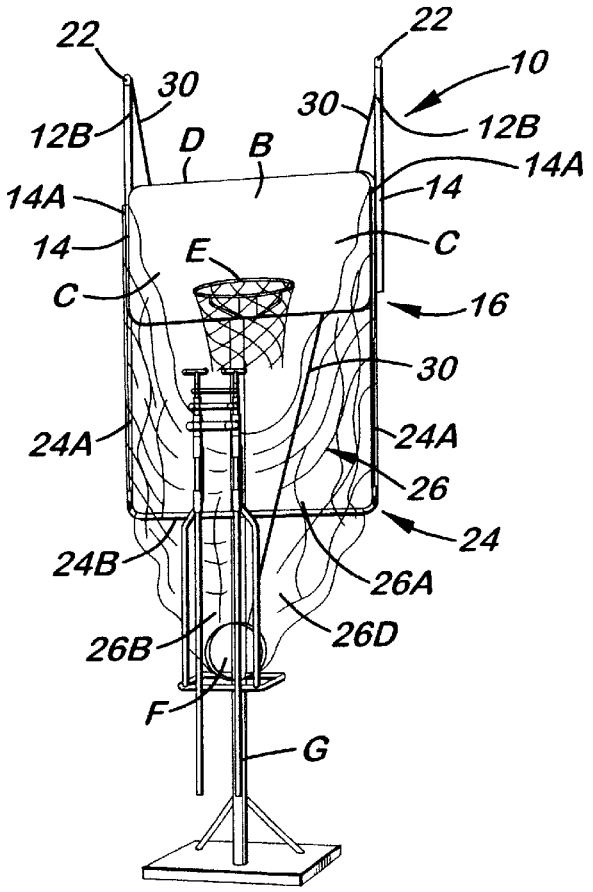
FIG. 2 is a front elevational view of the apparatus of FIG. 1 without a ground-supported basketball return structure being shown.
Figure 1:
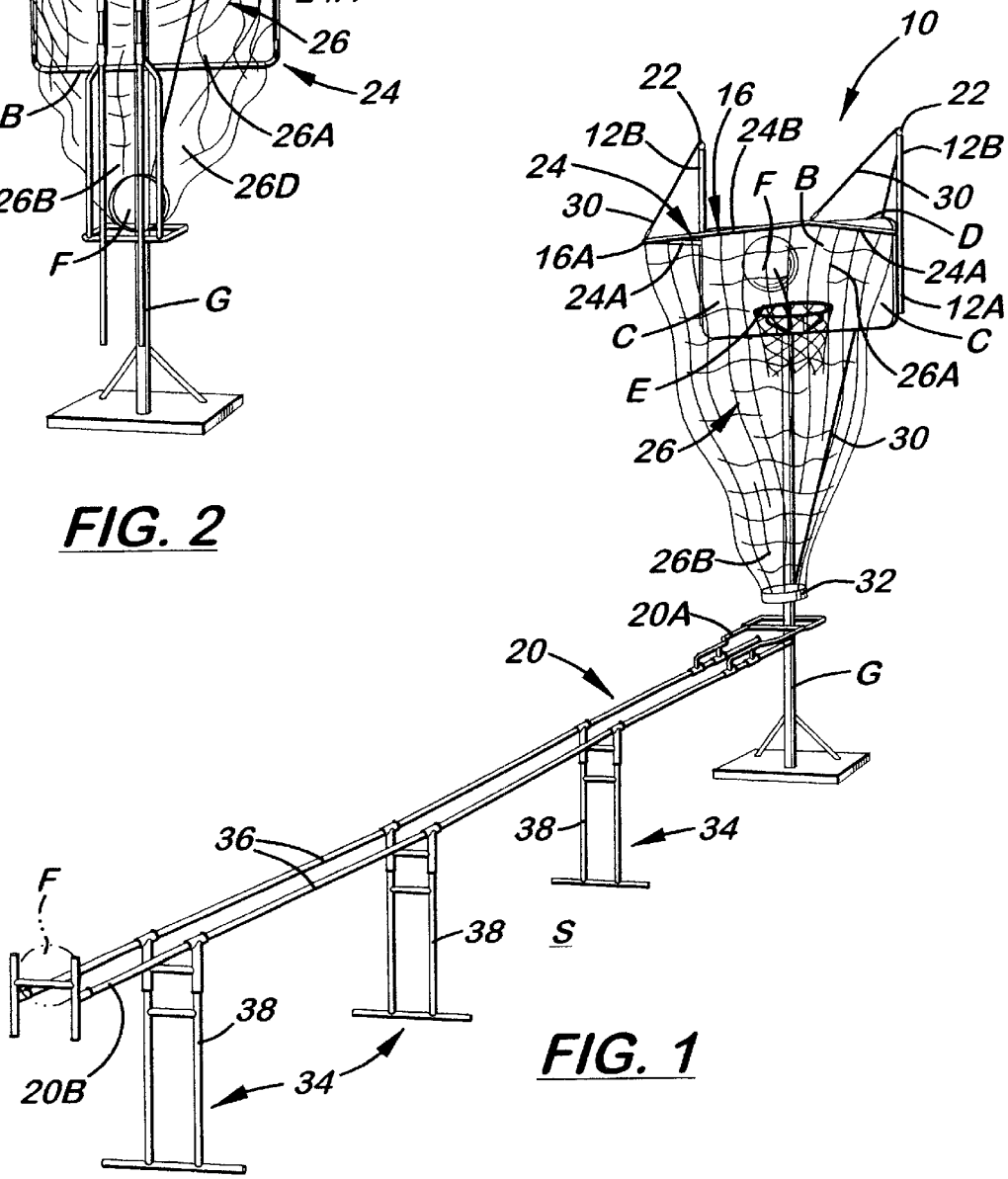
FIG. 1 is a perspective view of a basketball shooting practice return apparatus of the present invention.
Figure 3:
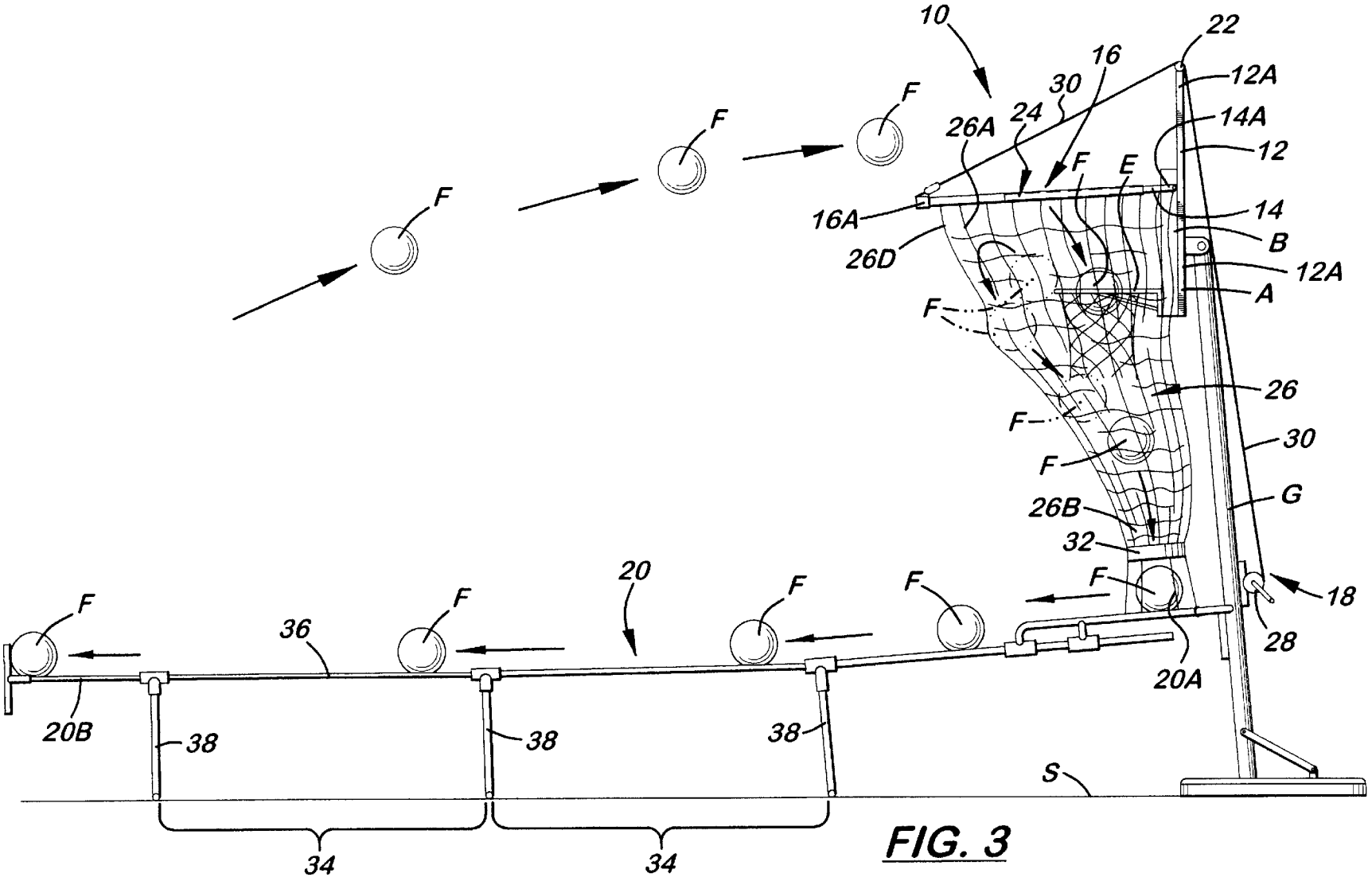
FIG. 3 is an enlarged side elevational view of the apparatus of FIG. 1 showing multiple basketballs being shot at a hoop on a backboard with which the apparatus is associated and being retrieved and returned from the hoop by use of the apparatus.
Figure 4:
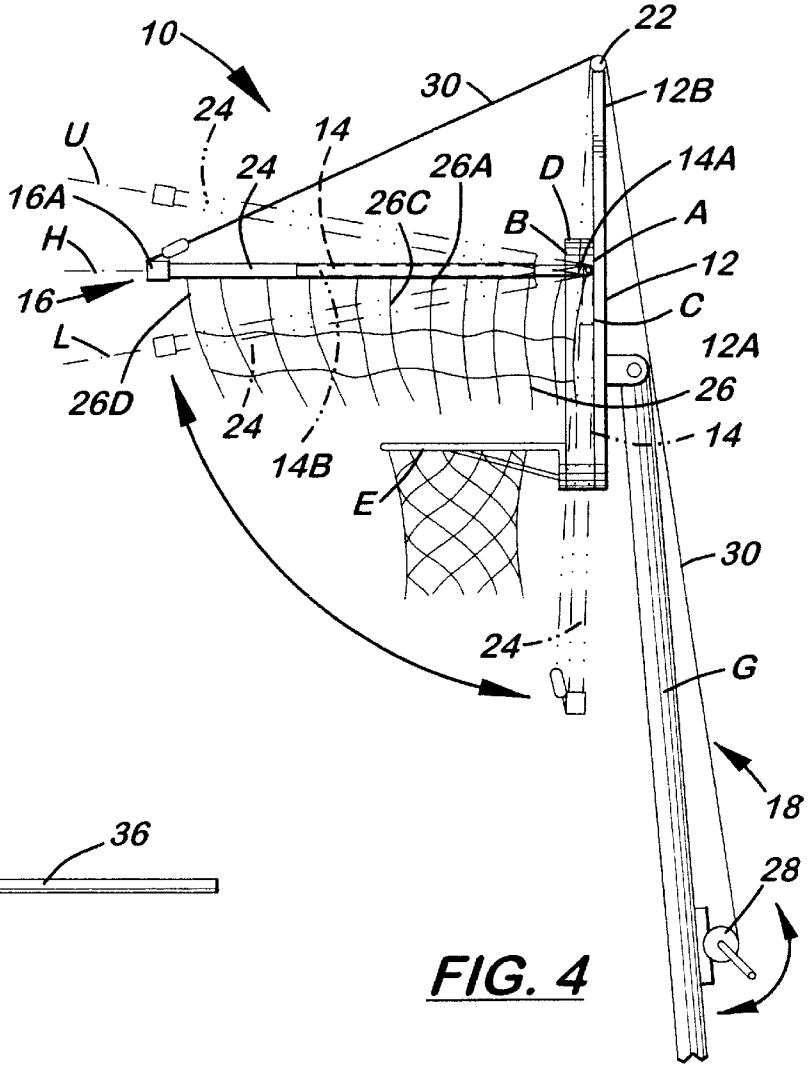
FIG. 4 is an enlarged side elevational view of a net positioning mechanism of the apparatus shown also in FIG. 1.

Referring to the drawings and particularly to FIGS. 1 to 4, there is illustrated a basketball shooting practice return apparatus, generally designated 10, of the present invention. The apparatus 10 basically includes a framework 12, a pair of support members 14, a retrieval net assembly 16, a net positioning mechanism 18, and a ground-supported basketball return structure 20. The framework 12 is mountable on a back A of a backboard B and has opposite lateral side portions 12A which extend beyond opposite lateral sides C and a top side D of the backboard B and are exposed from forwardly of the backboard B with the portions 12A having a pair of guide elements 22 thereon being located above the top side D of the blackboard B. The support members 14 are pivotally mounted to the framework 12 below the guide elements 22 thereon and above a hoop E on the backboard B. The retrieval net assembly 16 is supported by the support members 14 and is spaced outwardly and hangs downwardly from above the hoop E. The net positioning mechanism 18 is operable for selectively applying and releasing a pulling force upon the retrieval net assembly 16 and support members 14 from the direction of the guide elements 22 above the backboard B so as to be able to pivotally move the retrieval net assembly 16 and support members 14 between a raised position extending forwardly from the backboard B, as seen in FIGS. 1, 3 and 4, and a lowered vertical position extending downwardly from the backboard B, as seen in FIG. 2, and to hold the retrieval net assembly 16 and support members 14 at any stationary position therebetween. The ground-supported basketball return structure 20 is associated with the retrieval net assembly 16.

More particularly, the framework 12 of the apparatus 10 has a generally rectangular configuration and is attached and mounted to the back A of the backboard B such that the opposite vertical side portions 12A of the framework 12 are disposed beyond opposite sides C of the backboard B and exposed from forwardly of the backboard B. The support members 14 have generally straight rigid configurations and are pivotally mounted at their inner ends 14A thereof to the opposite vertical side portions 12A of the framework 12 at locations adjacent to upper ends of the opposite lateral sides C of the backboard B.

The retrieval net assembly 16 of the apparatus 10 includes a mounting frame 24 and a retrieval net 26 supported by the mounting frame 24. The mounting frame 24 of the assembly 16 is supported by the support members 14 and has a pair of opposite side frame members 24A and a front frame member 24B extending between and interconnecting the opposite side frame members 24A at forward ends thereof such that the mounting frame 24 has a generally U-shaped configuration. The opposite side frame members 24A of the mounting frame 24 are tubular in configuration and at their inner ends 24C are respectively slidably inserted over and removable from the support members 14 at outer ends 14B thereof.

The retrieval net 26 of the assembly 16 has a generally funnel-shaped configuration and an open top end 26A and an open bottom end 26B substantially smaller in size than the open top end 26A. The net 26 at opposite upper side portions 26C and upper front portion 26D of its open top end 26A is respectively secured around the opposite side frame members 24A and front frame member 24B so as to hang downwardly therefrom so as to locate the opposite upper side portions 26C and upper front portion 26D of the net 26 outwardly from and above the hoop E on the backboard B.

The net positioning mechanism 18 includes a manually or power-operated winch 28 located at ground level within reach of a person using the apparatus 10 and a pair of cables 30 wound over the winch 28. The cables 30 extend from the winch 28 upwardly to and through the guide elements in the form of loops 22 attached to upper ends of 12B of opposite lateral side portions 12A of the framework 12. The cables 30 then extend downwardly to corners 16A formed by the adjacent ends of the opposite side frame members 24A and front frame member 24B. When the tubular opposite side frame members 24A are inserted over the support members 14, the winch 28 can be operated by the person to wind and shorten the lengths of the cables 30 and thereby pull the cables 30 and lift the opposite side frame members 24A and support members 14 and retrieval net 26 therewith, to a desired use position relative to the backboard B and hoop E, for example, with the support members 14 and mounting frame 24 disposed in a horizontal position H, extending outwardly from the opposite side portions 12A of the framework 12. By the cables 30 being connected to the outer corners 16A of the assembly 16 and pulling rearwardly and upwardly therefrom, the cables 30 will retain the mounting frame 24 over the support members 14 at the desired use position. By a selected desired amount of unwinding or winding of the cables 30 from or around the winch 28 the support members 14 can be pivotally adjusted, raised or lowered, by a desired amount to change the use position of the mounting frame 24 and the support members 14 and net 26 therewith relative to the backboard B and hoop E. Further, by unwinding and thus lengthening the cables 30 the mounting frame 24 and the support members 14 and net 26 therewith can be pivotally lowered until the mounting frame 24 can slide off the support members 14 to thereby disassemble the retrieval net assembly 16 from the support members 14. Once removed from the support members 14, the retrieval net assembly 16 can be easily reduced in size for storage during periods of non-use. During periods of non-use, the support members 14 merely extend downwardly along the opposite side portions 12A of the framework 12 out of the way of the backboard B and hoop E for allowing normal use of the backboard B.

FIG. 4 also shows, at dashed lines U and L, both the mounting frame 24 and retrieval net 26 respectively adjusted to a raised upper inclined position U placing its front frame member 24B above the horizontal position H and at a first height above the shooting surface S (shown in FIG. 3) and a lowered inclined position L placing its front frame member 24B below the horizontal position H and at a second height above the shooting surface S which is less than the first height. The net positioning mechanism 18 is operable for selectively applying and releasing a pulling force upon the retrieval net assembly 16 and said support members 14 from the direction of the guide elements 22 above the backboard B so as to be able to pivotally move the retrieval net assembly 16 and support members 14 from the generally horizontal position H extending forwardly from the backboard B to the raised inclined position U extending forwardly and upwardly from the backboard B and above the hoop E and to the lowered inclined position L extending forwardly and downwardly from the backboard B and above the hoop E such that the height above the shooting surface S of the front frame member 24B of the retrieval net assembly 16 can be adjusted to act as a visual marker of the proper arch for the shooter to place on the basketball shot.

Figure 5:
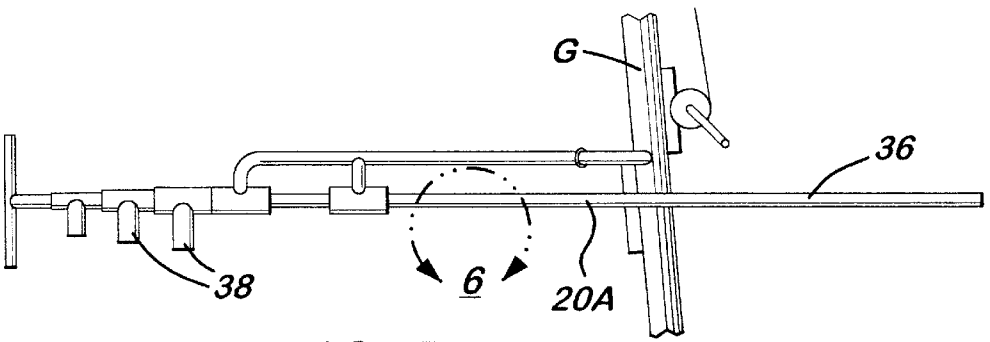
FIG. 5 is an enlarged fragmentary side elevational view of the basketball return structure in a collapsed condition.
Figure 7:
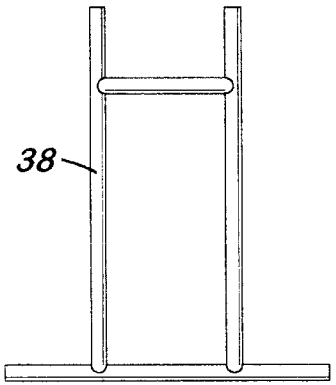
FIG. 7 is a front elevational view of one of the ground-engaging support stands of the basketball return structure of the apparatus.
Figure 6:
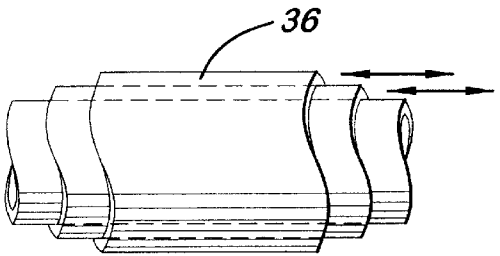
FIG. 6 is an enlarged fragmentary detailed view of a portion of the basketball return structure enclosed by circle 6.

The ground-supported basketball return structure 20 has one end 20A disposed adjacent to and below a collar 32 attached to the open lower end 26B of the retrieval net 26 for receiving a basketball F therefrom. The return structure 20 has an opposite end 20B disposed adjacent to the position where the person is shooting the basketball F. The return structure 20 includes a plurality of sections 34 extending between the opposite ends 20A, 20B thereof. Each section 34 has a pair of spaced apart elongated tracks 36 defining a path along which a basketball F can roll and ground-engaging support stands 38 detachably attached at upper ends to and extending downward from the tracks 36. As seen in FIGS. 5 and 6, the sections 34 telescopically interfit together at opposite ends so as to form the free-standing return structure 20 capable of being adjusted in length so as to extend from below the open lower end 26B of the net 26 to the desired location of the shooter. The sections 34 are easily taken apart and the support stands 38 removed to disassemble the return structure 20 for storage during periods of non-use.

Other advantages of the basketball shooting practice return apparatus 10 is that it can be mounted solely to the backboard B and thus is capable of being used in conjunction with both outdoor pole-supported backboards and indoor pole-free backboards. It is readily apparent that the parts of the apparatus 10 as described above are only mounted to the backboard B and not to the pole G supporting the backboard B. Thus, the apparatus 10 can be equally adapted for employment with a pole-supported or pole-free backboard.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A basketball shooting practice return apparatus, comprising:

(a) a framework for mounting on a backboard and having guide elements disposed above the backboard;

(b) a pair of support members pivotally mounted to said framework below said guide elements thereon and above a hoop on the backboard;

(c) a retrieval net assembly supported by said support members and spaced outwardly and hanging downwardly from above the hoop;

(d) a net positioning mechanism operable for selectively applying and releasing a pulling force upon said retrieval net assembly and said support members from the direction of said guide elements above the backboard so as to be able to pivotally move said retrieval net assembly and said support members between a raised position extending forwardly from the backboard and a lowered vertical position extending downwardly from the backboard and to hold said retrieval net assembly and support members at any stationary position therebetween; and (e) a basketball return structure associated with said retrieval net assembly.

2. The apparatus of claim 1 wherein said basketball return structure is adapted to receive a basketball from said retrieval net assembly and transfer the received basketball to a position where a person is located that is practice shooting the basketball.

3. The apparatus of claim 1 wherein said retrieval net assembly is slidably mounted to said support members such that said retrieval net assembly is removable from said support members when in said generally downward vertical position by releasing the pulling force.

4. The apparatus of claim 1 wherein said retrieval net assembly is slidably mounted to said support members such that said retrieval net assembly is removable from said support members by sliding off outer ends of said support members and said net positioning mechanism is connected to outer portions of said retrieval net assembly such that said retrieval net assembly is retained on said support members by said pulling force applied to said retrieval net assembly.

5. The apparatus of claim 1 wherein said net positioning mechanism includes a pair of elongated flexible members extending upwardly to and guidably past said guide elements on said framework and therefrom forwardly and downwardly to said retrieval net assembly adjacent said outer portion thereof so as to interconnect a pulling force generating source to said retrieval net assembly and be capable of transmitting, releasing and holding a pulling force applied upon said retrieval net assembly and said support members from above said support members.

6. The apparatus of claim 5 wherein said net positioning mechanism further includes a rotary motion generating device being said pulling force generating source.

7. The apparatus of claim 6 wherein said rotary motion generating device is a winch located within reach of a person using the apparatus and said elongated flexible members are cables wound over said winch and extending from said winch upwardly to and through said guide elements on said framework.

8. A basketball shooting practice return apparatus, comprising:

(a) a framework mountable on a backboard such that portions of said framework extend beyond opposite lateral sides and above a top side of the backboard and are exposed from forwardly of the backboard, said framework having a pair of guide elements located above the top side of the backboard on said portions of said framework extending above the top side of the backboard;

(b) a pair of support members pivotally mounted at inner ends thereof to said portions of said framework extending beyond opposite lateral sides of the backboard such that said inner ends of said support members are located below said guide elements and above a hoop on the backboard;

(c) a retrieval net assembly supported by said support members and spaced outwardly and hanging downwardly from above the hoop;

(d) a net positioning mechanism operable for selectively applying and releasing a pulling force upon said retrieval net assembly and said support members from the direction of said guide elements above the backboard so as to be able to pivotally move said retrieval net assembly and said support members from a generally horizontal position extending forwardly from the backboard to a raised inclined position extending forwardly and upwardly from the backboard and above the hoop and to a lowered inclined position extending forwardly and downwardly from the backboard and above the hoop such that the height above a shooting surface of a front portion of said retrieval net assembly can be adjusted to act as a visual marker of the proper arch for the shooter to place on the basketball shot; and (e) a basketball return structure associated with said retrieval net assembly.

9. The apparatus of claim 8 wherein said basketball return structure is adapted to receive a basketball from said retrieval net assembly and transfer the received basketball to a position where a person is located that is practice shooting that is practice shooting the basketball.

10. The apparatus of claim 8 wherein said retrieval net assembly is slidably mounted to said support members such that said retrieval net assembly is removable from said support members by sliding off outer ends of said support members and said net positioning mechanism is connected to outer portions of said retrieval net assembly such that said retrieval net assembly is retained on said support members by said pulling force applied to said retrieval net assembly.

11. The apparatus of claim 8 wherein said framework is mountable to a back of the backboard and said portions of said framework are opposite vertical side portions extending beyond the opposite sides of the backboard and above the top side of the blackboard such that said opposite vertical side portions of said framework are exposed from forwardly of the backboard, said opposite vertical side portions of said framework having said respective guide elements attached thereon at locations spaced above the top side of the blackboard.

12. The apparatus of claim 8 wherein said retrieval net assembly includes a mounting frame supported by said support members and having a pair of opposite side frame members and a front frame member extending between and interconnecting the opposite side frame members at forward ends thereof.

13. The apparatus of claim 12 wherein said opposite side frame members of said mounting frame are tubular in configuration and at inner ends thereof are respectively slidably inserted over and removable from said support members at outer ends of said support members.

14. The apparatus of claim 12 wherein said retrieval net assembly further includes a retrieval net supported by said mounting frame and being of a generally funnel-shaped configuration and open at opposite top and bottom ends with said open bottom end also being substantially smaller in size than said open top end, said retrieval net at opposite upper side portions and an upper front portion thereof being respectively secured to said opposite side frame members and front frame member of said mounting frame so as to hang downwardly therefrom and locate said opposite upper side portions and said upper front portion of said net outwardly from and above the hoop on the backboard.

15. The apparatus of claim 8 wherein said net positioning mechanism includes a pair of elongated flexible members extending upwardly to and guidably past said guide elements on said framework and therefrom forwardly and downwardly to said retrieval net assembly adjacent said outer portion thereof so as to interconnect a pulling force generating source to said retrieval net assembly and be capable of transmitting, releasing and holding the pulling force applied upon said retrieval net assembly and said support members from above said support members.

16. The apparatus of claim 15 wherein said net positioning mechanism further includes a rotary motion generating device being said pulling force generating source.

17. The apparatus of claim 16 wherein said rotary motion generating device is a winch located within reach of a person using the apparatus and said elongated flexible members are cables wound over said winch and extending from said winch upwardly to and through said guide elements on said framework.

18. The apparatus of claim 17 wherein said guide elements are in the form of loops attached to said framework.

19. The apparatus of claim 8 wherein said basketball return structure has one end disposed adjacent to and below said retrieval net for receiving a basketball therefrom, an opposite end disposed adjacent to the position where a person is shooting the basketball, and a plurality of sections interconnected one to the next and extending between said opposite ends of the structure, each of said sections having a pair of spaced apart elongated tracks defining a path along which a basketball can roll and a plurality of ground-engaging support stands detachably attached at upper ends to and extending downward from said tracks.

20. The apparatus of claim 19 wherein said sections telescopically interfit together at opposite ends thereof so as to form said free-standing return structure capable of being adjusted in length so as to extend from below said retrieval net to the desired location of the shooter, said sections being easily taken apart and said support stands removed to disassemble said return structure for storage during periods of non-use.

* * * * *